US006682245B2

(12) United States Patent
Saitou

(10) Patent No.: US 6,682,245 B2
(45) Date of Patent: Jan. 27, 2004

(54) CAP POSITIONING CONSTRUCTION

(75) Inventor: Juri Saitou, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/071,193

(22) Filed: Feb. 11, 2002

(65) Prior Publication Data

US 2002/0110404 A1 Aug. 15, 2002

(30) Foreign Application Priority Data

Feb. 13, 2001 (JP) ..... 2001-036203

(51) Int. Cl.[7] ..... B43K 23/12

(52) U.S. Cl. ..... 401/244; 401/98; 401/202; 401/246

(58) Field of Search ..... 401/61, 98, 124, 401/202, 213, 243–247, 262, 269; 24/11 R, 11 S; D19/56

(56) References Cited

U.S. PATENT DOCUMENTS 2,893,109 A * 7/1959 Young ..... 401/98
3,252,446 A * 5/1966 Bateman ..... 401/98

FOREIGN PATENT DOCUMENTS

JP 10-71796 3/1998
JP 2001-301381 A * 10/2001

* cited by examiner

*Primary Examiner*—Tuan N. Nguyen
(74) *Attorney, Agent, or Firm*—McGinn & Gibb, PLLC

(57) ABSTRACT

A cap positioning construction for positioning and mounting a cap to a barrel, includes a triangular notch formed in a step face of a barrel on which the end of a cap abuts, and a triangular extension formed at the end of the cap. The triangular extension extends toward the notch and matches the notch 12*e*. By fitting the extension in the notch, the cap is positioned relative to the barrel when the cap is mounted on the barrel.

17 Claims, 7 Drawing Sheets

CAP POSITIONING CONSTRUCTION

BACKGROUND OF THE INVENTION

1. Field of the Invention

The present invention relates to a cap positioning construction for positioning one element of a barrel and a cap (hereinafter referred to as a mounted element) relative to the other element of the barrel and the cap (hereinafter referred to as a mounting element) by placing the mounting element on the end portion of the mounted element.

2. Description of the Related Art

A conventional a cap positioning construction of this type, has been described, for example, in Japanese Patent Publication Laid-Open No. 10-71796. In the cap positioning construction described in the above publication, an inclined engaging portion is formed on the inside face of either one element of a barrel and a cap, whereas a receiving portion with which the engaging portion engages is formed on the other element, and the engaging portion or the receiving portion formed in the cap is formed on the inside face thereof. In this construction, by engaging the engaging portion with the receiving portion, the cap is fixed to the barrel. In order to remove the cap from the barrel, the cap is turned relatively with respect to the barrel, and thereby the cap is moved along an inclined face on which the engaging portion and the receiving element slide each other so as to separate from the barrel, by which the cap can be removed.

However, in the conventional cap positioning construction as described above, the engaging portion or the receiving portion is formed on the inside face of the cap, which is problematic in that the engaging portion or the receiving portion is invisible from the outside, so that the operation for installing the cap is difficult.

Also, the conventional cap positioning construction is unsuitable for being used commonly for writing instruments of different types in which different internal mechanisms are incorporated in the same barrel. For example, when the construction is applied to a mechanical pencil, since a lead is generally refilled, the cap must be detachable from the barrel. Contrarily, when the construction is applied to a ball-point pen, since a refill is generally replaced by removing a tip end member on the tip end of the barrel, the cap is preferably undetachable from the barrel to prevent the cap from being lost. Thus, it is difficult to apply the cap positioning construction commonly to a mechanical pen and a ball-point pen.

SUMMARY OF THE INVENTION

In view of the foregoing and other drawbacks, disadvantages and problems of the conventional methods and structures, a first object of the present invention is to provide a cap positioning construction that makes easy positioning a cap to a barrel.

Another object of the present invention is to provide a cap positioning construction that enables a cap and a barrel to be used commonly for both of the positioning construction in which the cap is detachable from the barrel and the positioning construction in which the cap is undetachable from the barrel.

To achieve the above objects, the present invention provides a cap positioning construction for positioning one element of a barrel and a cap (hereinafter referred to as a mounted element) relative to the other element of the barrel and the cap (hereinafter referred to as a mounting element) by placing the mounting element on the end portion of the mounted element. A triangular notch is formed in either one of a portion of the mounted element which abuts on the end portion of the mounting element and the end portion of the mounting element, and a triangular extension extending toward the notch and matching the notch is formed in the other, so that the mounted element is positioned relative to the mounting element by fitting the extension in the notch. With this construction, the cap can be mounted on the barrel while viewing the extension and the notch, so that the mounting operation is easy.

In order to more surely fix the mounted element to the mounting element, either one element of the mounted element and the mounting element may be formed with an protrusion projecting toward the other element, and the other element may be formed with a concave portion for receiving the protrusion, so that the protrusion and the concave portion are engaged lightly with each other.

The cap positioning construction can further comprise a clip formed integrally with said cap extending from a peripheral face of said cap toward the barrel, wherein a fitting position where said extension is fitted in said notch is disposed on a back face side of said clip. With this construction, the fitting position in which the extension is fitted in the notch is hidden by the clip, so that the appearance is not impaired. The clip can also be operated as a guide when the mounting operation is performed.

Further, an operating element for operating an internal mechanism in the barrel can be disposed on the peripheral face of the barrel, which lies on almost the same line as the clip in the axial direction when the mounted element is positioned relative to the mounting element. With this construction, the positional relationship in the circumferential direction between the cap and the barrel is determined unequivocally by fitting the extension in the notch, and thus the positional relationship between the clip and the operating element disposed on the peripheral face of the barrel can be determined unequivocally, so that the clip and the operating element can be disposed on almost the same line in the axial direction. Thus, both of the clip and the operating element can be disposed at a position at which they do not interfere with fingers when operation is performed with the barrel being held by hand, so that the operatability can be improved.

An engaged portion for being engaged with an engaging portion formed at a part of an internal mechanism projecting from the end of the barrel may be formed on the inside face of the cap. By forming in the cap the engaged portion for being engaged with the engaging portion of the internal mechanism, the cap can be mounted via the internal mechanism so as to be undetachable from the barrel. Thus, the same barrel and the same cap can be used merely by changing the internal mechanism in the barrel in both of the case where the positioning is performed so that the cap is detachable from the barrel and the case where the positioning is performed so that the cap is undetachable from the barrel.

An engaging portion can be formed in a portion of an internal mechanism in the barrel, which projects from an end of said barrel, and an engaged portion can be formed on the inside face of said cap to be firmly engaged with the engaging portion. By engaging the engaged portion of the cap with the engaging portion of the internal mechanism, the cap can be positioned relative to the barrel via the internal mechanism so as to be undetachable from the barrel.

At least one window hole may be formed in said barrel, and at least one elastic protrusion, which is engaged with said at least one window hole and for being elastically displaced in a radial direction, may be formed at a part of said internal mechanism. With this construction, the internal mechanism can be fixed surely in the barrel.

The present disclosure relates to subject matter contained in Japanese Patent Application No. 2001-36203, filed on Feb. 13, 2001, which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Embodiments of the present invention will now be described with reference to the accompanying drawings.

First Embodiment

Figure 1:
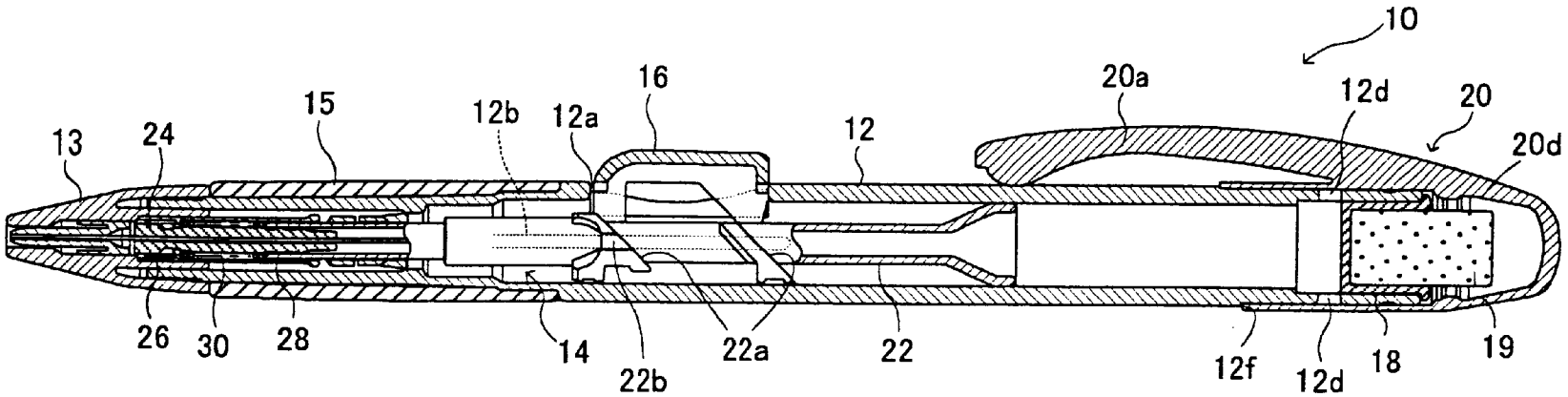
FIG. 1 is a longitudinal sectional view showing a first embodiment in which a construction for positioning a cap relative to a barrel in accordance with the present invention is applied to a mechanical pencil.

FIG. 1 shows a first embodiment in which a construction for positioning a cap relative to a barrel in accordance with the present invention is applied to a mechanical pencil. In FIG. 1, a side knock type mechanical pencil 10 mainly includes a barrel 12, a lead feeding mechanism 14 as an internal mechanism disposed within the barrel 12, a knock operating element 16 as an operating element installed swayably in an opening 12*a* formed in a central portion on the peripheral face of the barrel 12, an eraser receiver 18 with an eraser 19, which is detachably fitted at the rear end of the barrel 12, and a cap 20 which is detachably placed on the rear end portion of the barrel 12.

At the tip end of the barrel 12 is provided a tip end member 13, which is threaded in the body of the barrel 12. The tip end member 13 can be made integral with the body of the barrel 12. A rubber gripper 15 is fitted around a portion at the outer periphery of the barrel 12, which positionally corresponds to a portion of the barrel which is to be gripped by the user.

The lead feeding mechanism 14 has a well-known construction including a joint 22 provided with a cam portion 22*a* for being advanced in the axial direction by the swaying operation of the knock operating element 16, a chuck 24 the rear end of which is pressed into the front end portion of the joint 22 to tighten and feed a lead, a chuck ring 26 which is mounted around the chuck 24 to tighten the chuck 24, a sleeve 28 which is fixed to the barrel 12 to restrain the rearward movement of the chuck ring 26, and a chuck spring 30 as an elastic body disposed between the sleeve 28 and the joint 22 to urge the joint 22 and the chuck 24 rearwardly. The cam portion 22*a* of the joint 22 is formed with longitudinal grooves 22*b* at the side thereof. These longitudinal grooves 22*b* engage with longitudinal ribs 12*b* (see FIGS. 3 and 4) formed on the inside face of the barrel 12. Therefore, the joint 22 cannot be turned relatively with respect to the barrel 12 but can be moved in the axial direction. When the knock operating element 16 is knocked, the joint 22 is advanced by the cam portion 22*a* subjected to the swaying operation. At the same time, the chuck 24 advances, by which the lead is extended a predetermined amount. Since this mechanism and the operation thereof are publicly known, the detailed explanation thereof is omitted.

Figure 2:
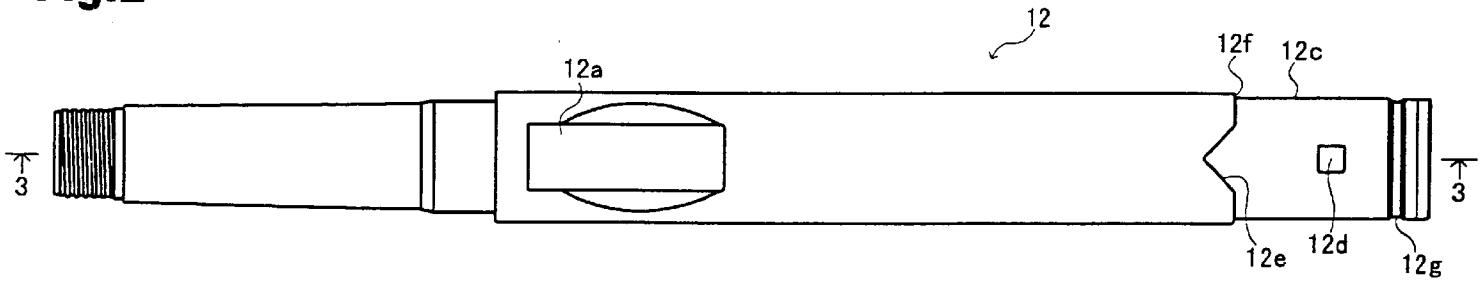
FIG. 2 is a plan view of a barrel in accordance with the present invention.
Figure 3:
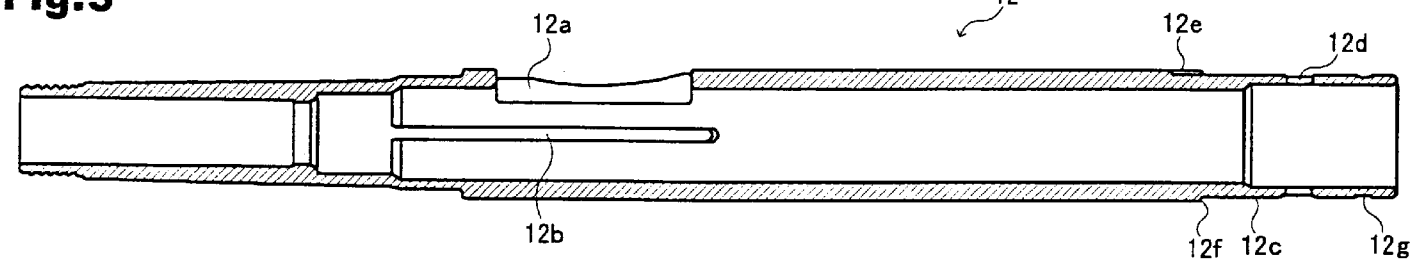
FIG. 3 is sectional view taken along the line 3—3 of FIG. 2 showing a barrel.
Figure 4:
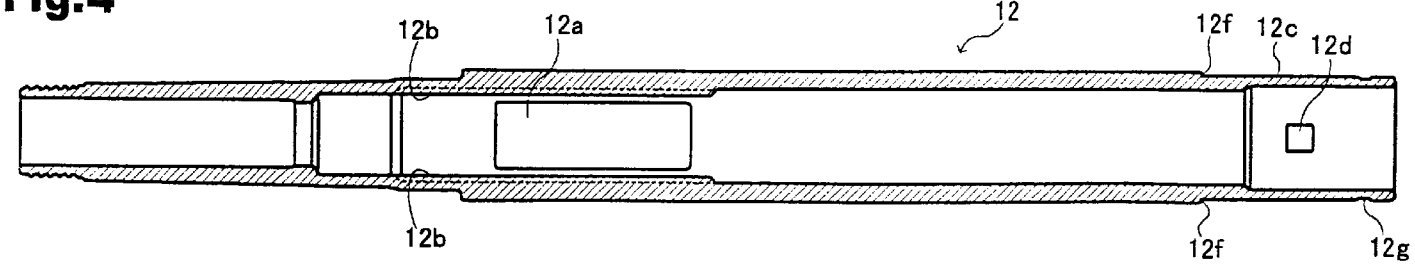
FIG. 4 is a sectional view of a barrel in a state of being turned through 90 degrees about its axis from the state shown in FIG. 3.

The rear end portion of the barrel 12 has a decreased diameter portion 12*c* having a smaller diameter than that of the central portion of the barrel 12 as shown in FIGS. 2 to 4. Between the decreased diameter portion 12*c* and a portion other than the decreased diameter portion 12*c*, a step face 12*f* is formed, and a triangular notch 12*e* is formed in the portion other than the decreased diameter portion 12*c* beyond the step face 12*f*. The notch 12*e* is disposed on the same line as the opening 12*a* in the axial direction. Further, on the peripheral face of the decreased diameter portion 12*c*, window holes 12*d*, 12*d* are formed so as to be spaced 180 degrees apart from each other in the circumferential direction. One of these window holes 12*d* is disposed on the same line with the notch 12*e* in the axial direction. Further, an annular groove 12*g* is formed on the outer peripheral face of the decreased diameter portion 12*c* at the rearward portion of the window hole 12*d*.

Figure 5:
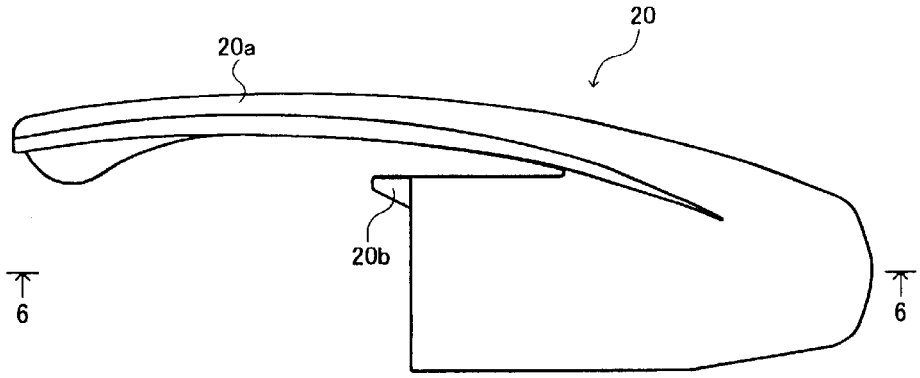
FIG. 5 is a front view of a cap in accordance with the present invention.
Figure 6:
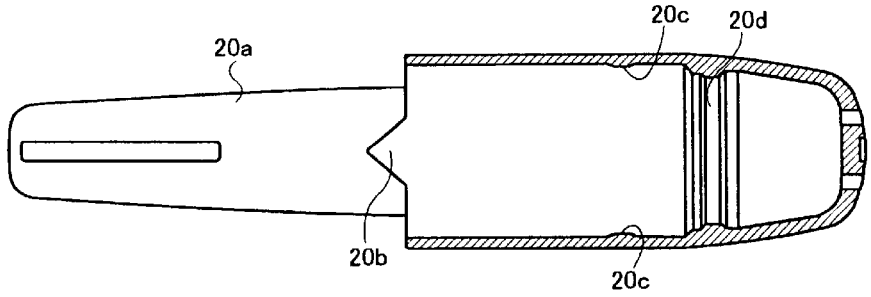
FIG. 6 is a sectional view taken along the line 6—6 of FIG. 5.
Figure 7:
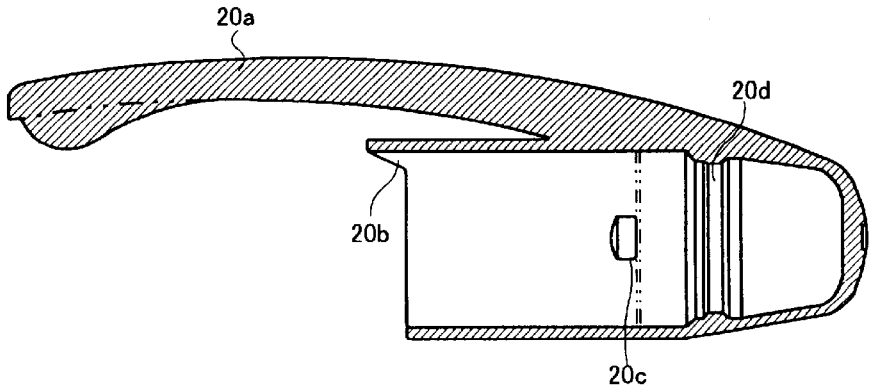
FIG. 7 is a sectional view of a cap in which the cap is rotated through 90 degrees around its axis from the state shown in FIG. 6.

As shown in FIGS. 5 to 7, the cap 20 fixed to the rear end portion of the barrel 12 is integrally formed with a clip 20*a* extending from the peripheral face of the cap body toward the barrel 12. In the same position in the circumferential direction as the clip 20*a*, in other words, on the cap body just on the back side of the clip 20*a*, an extension 20*b* is formed so as to project from the front end face of the cap 20 toward the front. The extension 20*b* has a triangular shape with almost the same size as the notch 12*e* so as to match the notch 12*e* (see FIG. 6). Further, two protrusions 20*c*, 20*c* projecting in the inside diameter direction are formed on the inner peripheral face of the cap body at positions spaced 90 degrees apart from the extension 20*b* in the circumferential direction. The protrusions 20*c*, 20*c* project slightly in the inside diameter direction. Also, an annular protrusion 20*d* (engaged portion), which is used in a second embodiment, is formed on the inner peripheral face of the cap body at the rearward portion of the protrusions 20*c*, 20*c*.

Figure 8:
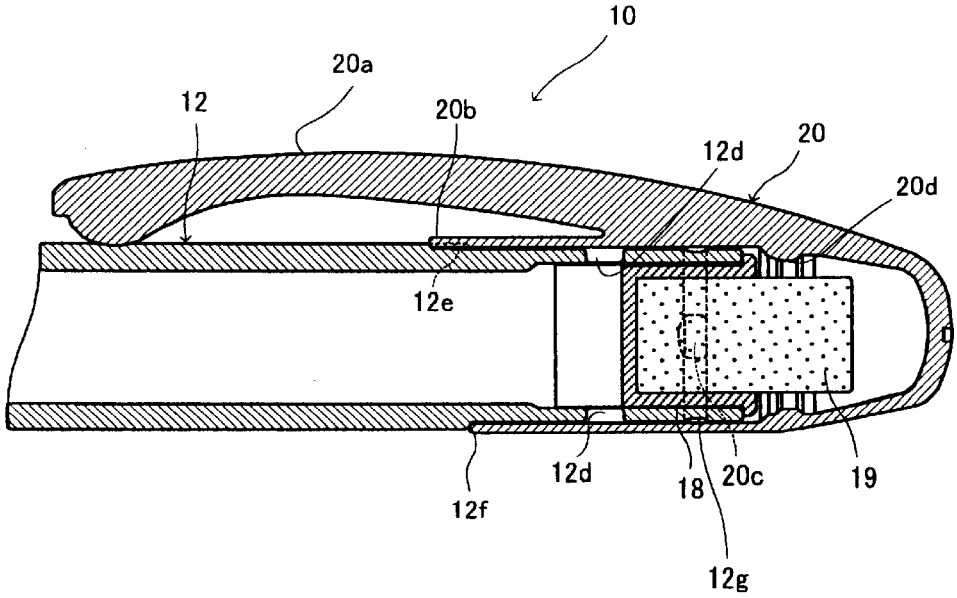
FIG. 8 is an enlarged sectional view of the construction for positioning a cap relative to a barrel shown in FIG. 1.
Figure 9:
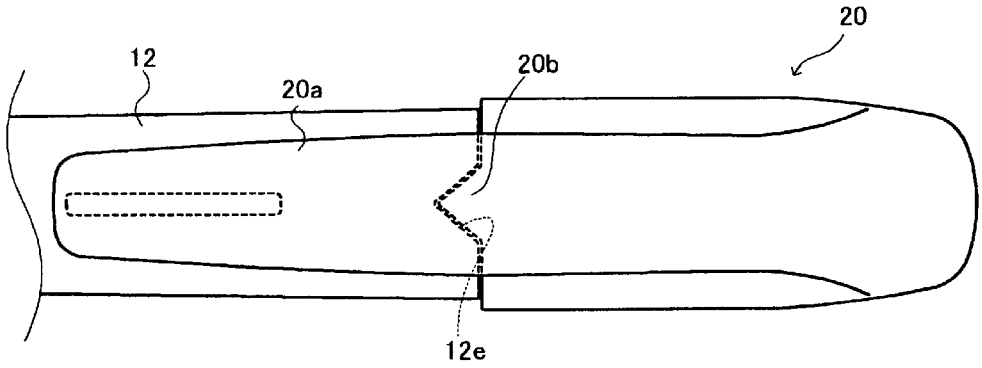
FIG. 9 is an enlarged plan view of the construction for positioning a cap relative to a barrel shown in FIG. 1.

In the state in which the cap 20 is mounted on the barrel 12, as shown in FIGS. 8 and 9, the extension 20*b* of the cap 20 is fitted in the notch 12*e* of the barrel 12, and the front end face of the cap 20 abuts on the step face 12*f* of the barrel 12, whereby the front end position thereof is regulated. Since the extension 20*b* and the notch 12*e* are located on the back face side of the clip 20*a*, they are not exposed conspicuously to the surface side, so that the appearance is not impaired. Further, the protrusions 20*c*, 20*c* of the cap 20 engage lightly with the groove 12*g* in the barrel 12 so that the cap 20 is prevented from moving easily with respect to the barrel 12. Since the protrusions 20*c*, 20*c* and the groove 12*g* are also hidden in the cap 20, the appearance is not impaired.

In order to refill a lead or to use the eraser 19, the cap 20 is pulled while being turned slightly with respect to the barrel 12, by which the cap 20 is moved along the oblique line of the notch 12*e* because the oblique line of the triangular extension 20*b* is in slidable contact with the oblique line of the similarly triangular notch 12*e*. Thereby, the cap 20 is moved rearward from the barrel 12 in the axial direction, whereby the cap 20 can be removed from the barrel 12.

In order to mount the cap 20 on the barrel 12 again, the cap 20 is moved while the clip 20*a* is used as a guide or while the extension 20*b* is directly observed visually so that the position in the circumferential direction of the clip 20*a* or the extension 20*b* coincides with that of the notch 12*e* of the barrel 12. Thereby, the position in the circumferential direction of the extension 20*b* of the cap 20 can be aligned easily with that of the notch 12*e* of the barrel 12, so that the user can position the cap 20 relative to the barrel 12 without being perplexed to align the positions in the circumferential direction. At this time, even if the positions in the circumferential direction of the cap 20 and the barrel 12 somewhat shift from each other, the oblique lines of triangles of the extension 20*b* of the cap 20 and the notch 12*e* of the barrel 12 slide relatively, by which the extension 20*b* is fitted properly in the notch 12*e*.

Also, since the extension 20*b* is fitted in the notch 12*e* in this manner, the positions in the circumferential direction of the clip 20*a* and the barrel 12 are determined unequivocally.

As described above, with this embodiment, the cap 20 can be mounted on the barrel 12 while viewing extension 20*b* extending in the axial direction from outside or using the clip 20*a* as a guide, so that the mounting operation is easy.

On the other hand, the portion where the extension 20*b* is fitted in the notch 12*e* is not visible easily from outside due to the presence of the clip 20*a*, so that the mechanical pencil's appearance is not marred.

Further, the protrusions 20*c*, 20*c* of the cap 20 engage lightly with the grooves 12*g* in the barrel 12, by which a fitting force between the cap 20 and the barrel 12 can be strengthened.

Additionally, the positions in the circumferential direction of the cap 20 and the barrel 12 are determined unequivocally, and the clip 20*a* and the opening 12*a* in the barrel 12 are aligned in the circumferential direction. Specifically, the knock operating element 16 installed in the opening 12*a* and the clip 20*a* are aligned in the circumferential direction. Therefore, at the time of use, writing can be performed in the state in which both of the clip 20*a* and the knock operating element 16 are disposed on the upside to provide ease of operation.

During mounting, even if the positions in the circumferential direction of the cap 20 and the barrel 12 shift from each other, the oblique lines of the triangular notch 12*e* and triangular extension 20*b* slide relatively, by which both of the elements are guided to proper positions in the circumferential direction.

Second Embodiment

Figure 10:
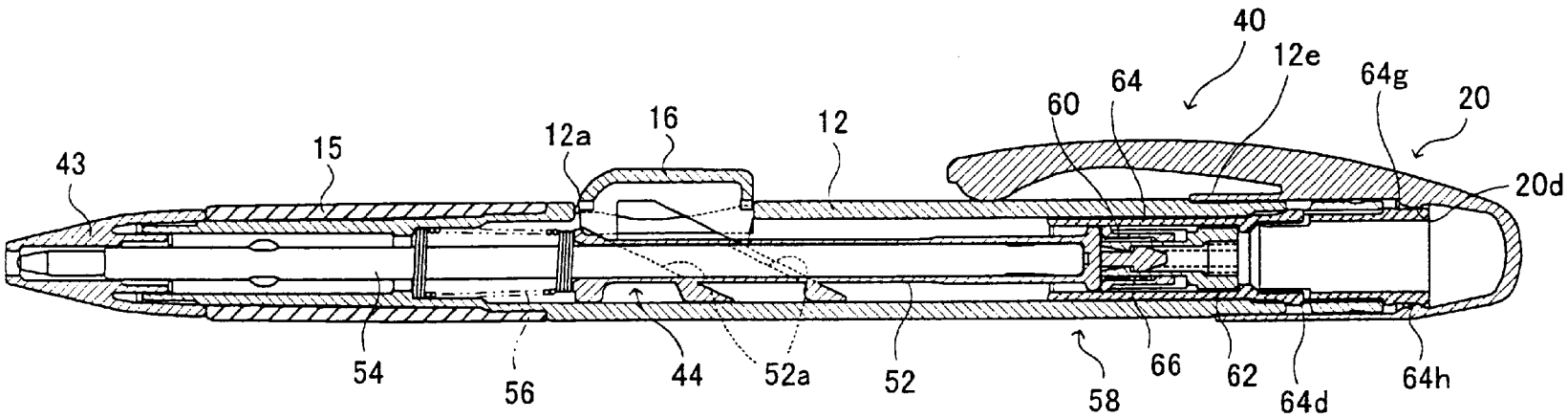
FIG. 10 is a longitudinal sectional view showing a second embodiment in which a construction for positioning a cap relative to a barrel in accordance with the present invention is applied to a ball-point pen.

FIG. 10 shows a second embodiment in which a construction for positioning a cap relative to a barrel in accordance with the present invention is applied to a ball-point pen.

In FIG. 10, a side knock type ball-point pen 40 mainly includes a barrel 12, a refill feeding mechanism 44 as an internal mechanism disposed within the barrel 12, a knock operating element 16 installed swayably in an opening 12*a* formed at a side central portion of the barrel 12, and a cap 20 fixed undetachable to the rear end of the barrel 12. At the tip end of the barrel 12, is provided a tip end member 43, which is threaded in the body of the barrel 12. A rubber gripper 15 is fitted around the outer periphery of the barrel, which positionally corresponds to a portion which is to be gripped by the user. In this embodiment, the same reference numerals are applied to the elements similar to those in the first embodiment. It should be noted that a considerable number of elements, except for the feeding mechanism, can be used commonly for the mechanical pencil and the ball-point pen.

The refill feeding mechanism 44 includes a refill receiver 52 provided with a cam portion 52*a* for being advanced in the axial direction by a swaying operation of the knock operating element 16, a refill 54 having a rear end which is accommodated by the refill receiver 52, a return spring 56 for urging the refill receiver 52 rearwardly, and a rotating cam mechanism 58.

Figure 11:
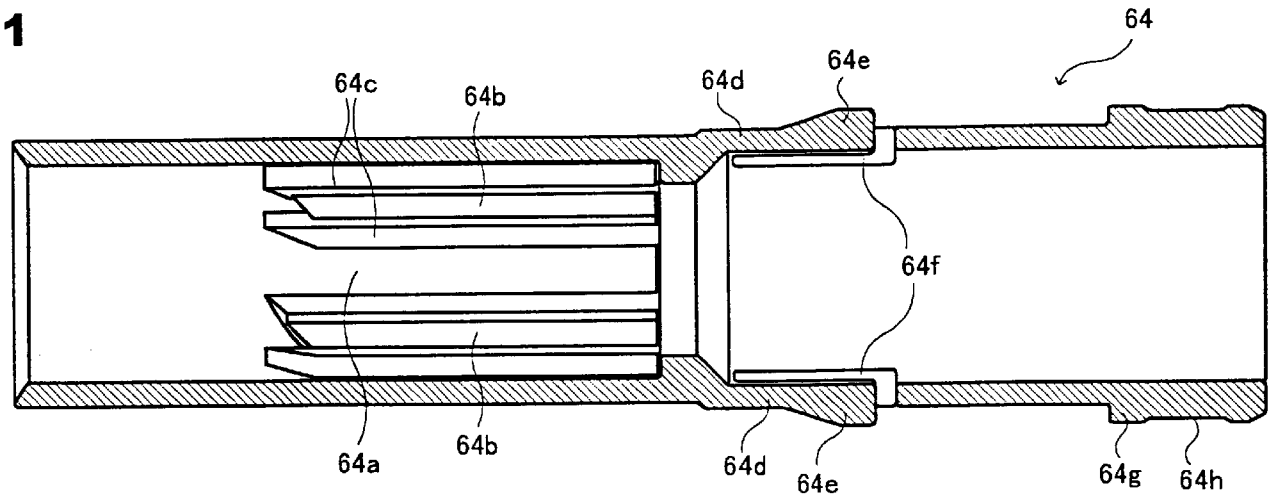
FIG. 11 is a longitudinal sectional view of a cam body.
Figure 12:
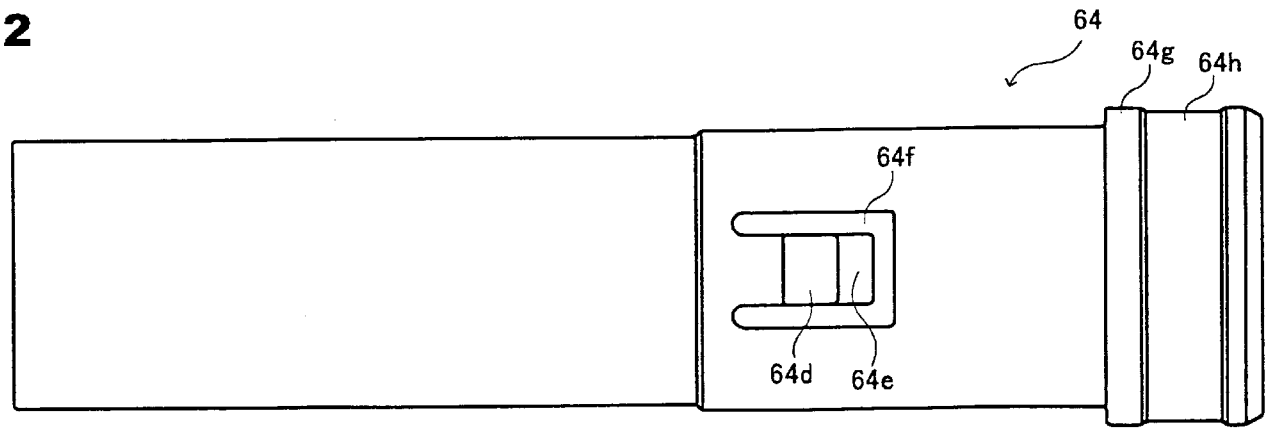
FIG. 12 is a plan view of a cam body.
Figure 13:
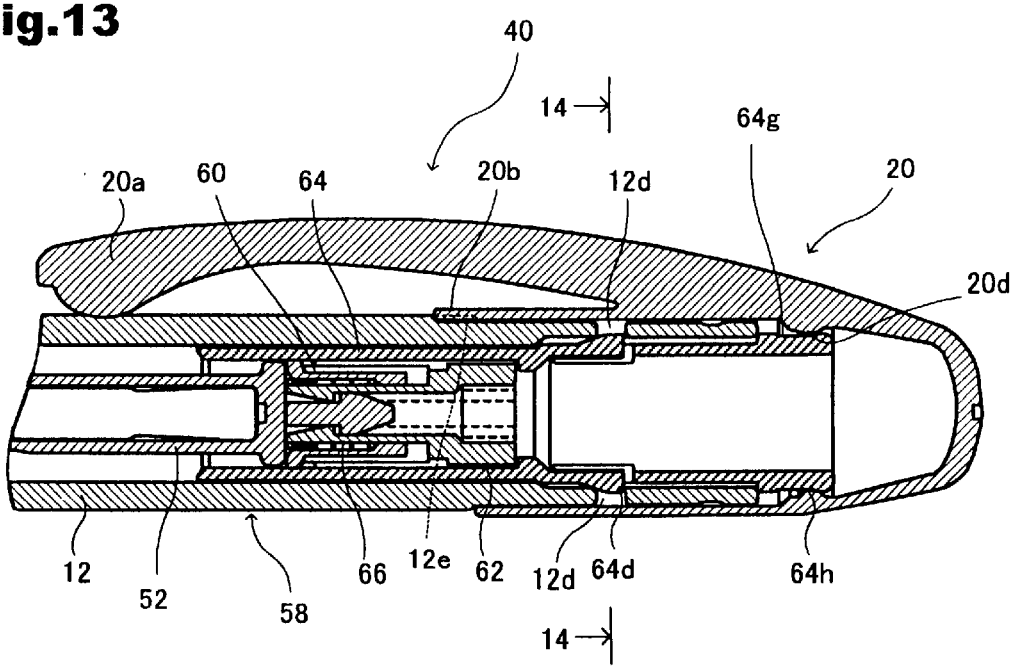
FIG. 13 is an enlarged sectional view of the construction for positioning a cap relative to a barrel shown in FIG. 10.
Figure 14:
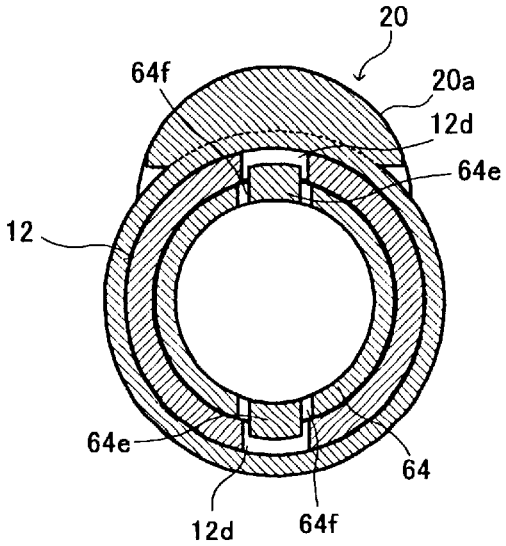
FIG. 14 is a sectional view of a barrel, cap, and cam body taken along the line 14—14 of FIG. 13.

The rotating cam mechanism 58 includes a rotating cam 60, a cam bar 62, a cam body 64, and a spring 66. The rear end of the refill receiver 52 is pressed in the front end of the cam bar 62. As shown in FIG. 11, in the inner peripheral face of the cam body 64, deep grooves 64*a* and shallow grooves 64*b* are formed alternately in the circumferential direction via ridges 64*c* disposed therebetween. The cam bar 62 is disposed unrotatably in the cam body 64, and the front end of the cam bar 62 is formed with a plurality of cam faces engaging the rotating cam 60. The rotating cam 60 is formed with at least one convex portion (not shown) for being inserted in any one of the deep grooves 64*a* of the cam body 64 and incapable of being inserted in the shallow grooves 64*b*. The spring 66 is interposed between and urges the rotating cam 60 and the refill receiver 52 in the direction such that they are always separated from each other. A spring force of the spring 66 is set so as to be weaker than that of the return spring 56.

When the circumferential position of the convex portion (not shown) of the rotating cam 60 coincides with the deep groove 64*a*, the convex portion of the rotating cam 60 is inserted into the deep groove 64*a* by the urging force of the return spring 56 and the spring 66, so that the rotating cam 60 retreats. Therefore, the refill receiver 52 also moves to a retreat position, so that the front end of the refill 54 retreats from the tip end of the tip end member 43 (the state shown in FIG. 10).

On the other hand, when the knock operating element 16 is knocked, the cam portion 52*a* is subjected to the swaying operation of the knock operating element 16, whereby the refill receiver 52 is advanced. Therefore the cam bar 62 connected to the refill receiver 52 is advanced. The advance of the cam bar 62 pushes the rotating cam 60 forwardly, such that the convex portion of the rotating cam 60 is disengaged from the deep grooves 64*a*. When the knock of the knock operating element 16 is released, the cam faces of the cam bar 62 rotate the rotating cam 60 in the predetermined direction with resort to the urging force of the spring 66, so that the convex portion of the rotating cam 60 is locked to the front end of any one of the shallow grooves 64*b*, and thus the rotating cam 60 is held at the advanced position. Therefore, the refill receiver 52 is also located at the advanced position and the front end of the refill 54 projects from the tip end of the tip end member 43. Since the mechanism and operation of the rotating cam mechanism are well known, further detailed explanation thereof is omitted.

On the outer peripheral face at the rear part of the cam body 64, a pair of elastic members 64*d* are formed so as to be spaced 180 degrees apart from each other in the circumferential direction. Specifically, each of the elastic member 64*d* is formed such that three sides thereof are surrounded with a slit 64*f*, so that it can be displaced elastically in the radial direction. An elastic protrusion 64*e* is formed on the outside face at the tip end of each of the elastic members 64*d*. The elastic protrusion 64*e* engages the corresponding one of the window holes 12*d*, 12*d* in the barrel 12, which have been described in the first embodiment.

During assembly, the cam body 64 is inserted from the rear side of the barrel 12, and the cam body 64 is moved into the barrel 12 until the elastic protrusions 64*e* of the elastic members 64*d* reach the window holes 12*d* while pressing the elastic members 64*d* in the inside diameter direction by utilizing the elasticity of the elastic members 64*d*. After the elastic protrusions 64*e* reach the window holes 12*d* and engage the window holes 12*d*, the cam body 64 will not detach from the barrel 12 inadvertently.

Further, at the rear end portion of the cam body 64, there is formed a projecting portion 64*g* projecting from the rear of the barrel 12 when installed to the barrel 12. The projecting portion 64*g* is formed with an annular concave portion (engaging portion) 64*h*. The annular concave portion 64*h* is formed so that the annular protrusion 20*d* of the cap 20 engage the annular concave portion 64*h*.

As in the first embodiment, an extension 20*b* of the cap 20 is fitted in a notch 12*e* of the barrel 12, and protrusions 20*c*, 20*c* thereof are engaged lightly with a groove 12*g* in the barrel 12. Further, an annular protrusion 20*d* of the cap 20 is firmly engaged with the annular concave portion 64*h* in the cam body 64, by which the cap 20 is installed undetachably to the barrel 12 via the cam body 64.

This embodiment achieves the same effects as the effects described above with regard to the first embodiment. In addition, this embodiment also achieves the following effect.

In the first embodiment in which the cap positioning construction is applied to a mechanical pencil, the cap 20 must be detachable from the barrel 12 for the purposes of the refilling of a lead and the use of the eraser. In contrast, in the second embodiment in which the cap positioning construction is applied to a ball-point pen, the refill 54 can be replaced by unscrewing the tip end member 43 from the barrel 12. Therefore, the cap 20 is preferably installed to the barrel 12 so as to be undetachable from the barrel 12. Therefore, by fixing the cap 20 to the cam body 64 installed to the barrel 12 by utilizing the window holes 12*d* in the barrel 12, the cap 20 can be fixed firmly on the barrel 12 via the cam body 64. Thus, the barrel 12 and the cap 20 commonly employed for the first embodiment, can be used for the second embodiment, so that the manufacturing cost, the cost required for parts management, and other costs can be decreased.

Although the notch is formed on the barrel and the extension having a shape matching the notch is formed on the cap in the above-described embodiments, the configuration is not limited thereto. Hence, a configuration in which the notch is formed on the cap and the extension matching the notch is formed on the barrel is also possible. Similarly, although the cap is placed on the end of the barrel in the embodiments, the configuration is not limited thereto. A configuration in which the barrel is placed on the end of the cap is also possible.

As described above, according to the present invention, since the extension or the notch can be observed visually, the operation for mounting the cap on the barrel can be performed easily.

The cap and the barrel can be used commonly in both of the case where the cap and the barrel are detachable from each other and the case where these elements are undetachable from each other.

While the invention has been described in terms of several preferred embodiments, those skilled in the art will recognize that the invention can be practiced with modification within the spirit and scope of the appended claims.

What is claimed is:

1. A cap positioning construction for positioning one element of a barrel and a cap, as a mounted element, relative to another element of the barrel and the cap, as a mounting element, by placing the mounting element on the end portion of the mounted element, said cap positioning construction comprising:

a triangular notch formed in either one of a portion of the mounted element which abuts on an end portion of the mounting element and an end portion of the mounting element;

a triangular extension formed on the other and extending toward said notch so as to be matched with said notch, such that the mounted element is positioned relative to the mounting element by fitting said extension in said notch; and an engaged portion formed on an inside face of said cap for being engaged to an engaging portion formed at a part of an internal mechanism disposed within the barrel and projecting from an end of said barrel.

2. The cap positioning construction according to claim 1, further comprising:

a clip formed integrally with said cap and extending from a peripheral face of said cap toward the barrel, wherein a fitting position where said extension is fitted in said notch is disposed on a back face side of said clip.

3. The cap positioning construction according to claim 2, further comprising:

an operating element disposed on a peripheral face of said barrel for operating said internal mechanism in said barrel, said operating element lying on almost the same line as said clip in an axial direction when the mounted element is positioned relative to the mounting element.

4. The cap positioning construction according to claim 3, wherein said engaging portion is formed in the projecting portion of said internal mechanism; and said engaged portion is firmly engaged with said engaging portion.

5. The cap positioning construction according to claim 4, further comprising:

at least one window hole formed in said barrel; and at least one elastic protrusion, which is engaged with said at least one window hole and for being elastically displaced in a radial direction, formed at a part of said internal mechanism.

6. The cap positioning construction according to claim 2, wherein said engaging portion is formed in the projecting portion of said internal mechanism, and said engaged portion is firmly engaged with said engaging portion.

7. The cap positioning construction according to claim 6, further comprising:

at least one window hole formed in said barrel; and at least one elastic protrusion, which is engaged with said at least one window hole and for being elastically displaced in a radial direction, formed at a part of said internal mechanism.

8. The cap positioning construction according to claim 1, wherein said engaging portion is formed in the projecting portion of said internal mechanism, and said engaged portion is firmly engaged with said engaging portion.

9. The cap positioning construction according to claim 8, further comprising:

at least one window hole formed in said barrel, and at least one elastic protrusion, which is engaged with said at least one window hole and for being elastically displaced in a radial direction, formed at a part of said internal mechanism.

10. A cap positioning construction for a hand-held device, comprising:

a first element, formed by one of a barrel and a cap, comprising an end portion;

a second element, formed by the other of said barrel and said cap, for placing onto said end portion of said first element;

a notch, formed in either one of a portion of the first element which abuts on an end portion of the second element and an end portion of the second element;

an extension, formed on the other portion and extending toward said notch so as to be matched with said notch, such that the first element is positioned relative to the second element by fitting said extension in said notch; and an engaged portion formed on an inside face of said cap for being engaged with an engaging portion formed at a part of an internal mechanism that is disposed within said barrel and projecting from an end of said barrel.

11. The cap positioning construction according to claim 10, further comprising:

an operating element disposed on a peripheral face of said barrel for operating said internal mechanism in said barrel, said operating element lying on almost the same line as said clip in an axial direction when the mounted element is positioned relative to the mounting element.

12. The cap positioning construction according to claim 10, wherein said engaging portion is formed in the projecting portion of said internal mechanism, and said engaged portion is firmly engaged with said engaging portion.

13. The cap positioning construction according to claim 12, further comprising:

at least one window hole formed in said barrel, and at least one elastic protrusion, which is engaged with said at least one window hole and for being elastically displaced in a radial direction, formed at a part of said internal mechanism.

14. The cap positioning construction according to claim 10, wherein said notch comprises a triangular notch.

15. The cap positioning construction according to claim 10, wherein said extension comprises a triangular extension.

16. The cap positioning construction according to claim 10, further comprising:

a clip, formed integrally with said cap, and extending from a peripheral face of said cap toward the barrel.

17. The cap positioning construction according to claim 16, wherein a fitting position where said extension is fitted in said notch is disposed on a back face side of said clip.

* * * * *